United States Patent [19]

LeBegue et al.

[11] Patent Number: 4,582,363

[45] Date of Patent: Apr. 15, 1986

[54] DRIVE ASSEMBLY FOR MINING MACHINE CUTTER DRUM

[75] Inventors: Maurice K. LeBegue, Argillite, Ky.; Gerald L. Baum, Belleville, Ill.

[73] Assignee: National Mine Service Company, Pittsburgh, Pa.

[21] Appl. No.: 567,630

[22] Filed: Jan. 3, 1984

[51] Int. Cl.[4] ..... E21C 27/20

[52] U.S. Cl. ..... 299/76; 299/78; 299/89

[58] Field of Search ..... 299/76, 89, 75, 78

[56] References Cited

U.S. PATENT DOCUMENTS

| | | | |
|---|---|---|---|
| 2,751,204 | 6/1956 | Sibley | 299/76 |
| 2,758,826 | 8/1956 | Paget | 299/78 |
| 3,101,932 | 8/1963 | Wright | 299/39 |
| 3,141,703 | 7/1964 | Gonski | 299/71 |
| 3,290,096 | 12/1966 | Stalker | 299/78 |
| 3,305,273 | 2/1967 | Kilbourne | 299/78 |
| 3,307,880 | 3/1967 | Newton et al. | 299/75 |
| 3,773,384 | 11/1973 | Anderson | 299/76 |
| 3,774,969 | 11/1973 | LeBegue | 299/76 |
| 3,848,930 | 11/1974 | LeBegue | 299/76 |
| 3,966,257 | 6/1976 | Shah | 299/76 |
| 4,253,705 | 3/1981 | LeBegue | 299/76 |
| 4,270,803 | 6/1981 | Baum | 299/76 |
| 4,310,199 | 1/1982 | Freed, Jr. et al. | 299/76 |

*Primary Examiner*—Stephen J. Novosad

*Assistant Examiner*—Michael A. Goodwin

*Attorney, Agent, or Firm*—Stanley J. Price, Jr.

[57] ABSTRACT

A continuous mining machine includes a mobile body portion with a cutter drum member rotatably mounted on the front of a boom member which extends forwardly of the body portion. The cutter drum member has an intermediate drum section and a pair of canted end drum sections. Driven input shafts extend through openings between the intermediate section and the end drum sections. Each input shaft is drivingly connected to a first stage of a two stage planetary gear assembly which surrounds an end drum drive shaft that extends the length of each end drum section. A second stage of the planetary gear assembly is drivingly connected to and is axially aligned with the first stage to transmit rotation outwardly to the end of the end drum section. A shearable driving coupling is axially positioned on the end drum drive shaft at the end of the end drum section. An external portion of the drive coupling is connected to the second stage and an internal portion is connected to the end drum drive shaft. The drive coupling transmits rotation from the second stage to the end drum drive shaft and therefrom to a drive shaft for rotating the intermediate drum section. In the event the load on the end drum section during the mining operation exceeds a predetermined magnitude, the drive coupling shears to prevent damage to the other drive components under overload conditions.

12 Claims, 5 Drawing Figures

DRIVE ASSEMBLY FOR MINING MACHINE CUTTER DRUM

BACKGROUND OF THE INVENTION

1. Field of the Invention

This invention relates to a continuous mining machine and, more particularly, to a mining machine having a cutter drum drive assembly that includes input drive shafts for transmitting rotation to a pair of canted end drum sections and to an intermediate drum section to rotate a drum assembly at a preselected speed for reduced dust generation while dislodging mine material in a manner that extends the operating life of the drive assembly.

2. Description of the Prior Art

Continuous mining machines, as illustrated in the U.S. Pat. No. 3,774,969, are utilized in underground mining operations to continuously dislodge solid material from the face of a mine shaft. A boom member extends forwardly from an elongated body portion of the mining machine that is propelled through the mine on endless crawler tracks. The boom member is pivotally connected to the mining machine body portion and rotatably supports a cutter drum assembly having peripherally extending elements. The cutter drum assembly extends transversely to the longitudinal axis of the body portion and, upon rotation, the cutting elements dislodge solid material from the mine face.

The cutter drum assembly is pivoted through an arcuate vertical path and sumped into the mine face to make a shear cut in the mine face. The dislodged material is fed rearwardly onto a gathering platform having suitable gathering devices which direct the dislodged material rearwardly onto a conveyor that extends longitudinally on the mining machine to transport the material toward the rear of the mining machine. By dislodging mineral material from the mine face in this manner, a mine passageway or room is formed to thus permit the mining machine to advance and continuously dislodge material from the mine face.

Full face drum-type mining machines, as illustrated in U.S. Pat. No. 3,305,273, include support means and drive means for the drum. The support and drive means include fixed annular end portions of the boom member extending around the external surface of the drum. Endless chain elements with cutter bits mounted thereon extend around the support means to dislodge material from the mine face along the width of the annular end portions of the supporting boom.

As disclosed in U.S. Pat No. 3,774,969, the drum member has an intermediate drum section and canted end drum sections with rear openings between the inner ends of the end drum sections and the outer ends of the intermediate drum section. Input shafts extend through these openings and each input shaft includes at its outer end a drive pinion meshing with a bevel gear rotatably supported within the intermediate drum section. The bevel gear is splined to a shaft with a sun gear of a planetary gear train nonrotatably mounted thereon. Planet gears of the planetary gear train are secured to the intermediate drum section and are rotated by the driven sun gear. The planet gears are also connected through universal joints to the adjacent canted end drum section.

The above described arrangement of transferring rotation from the intermediate drum section through a planetary gear train to the end drum sections requires a relatively large diameter intermediate drum section in order to accommodate the planetary gearing. This type of drum drive is particularly adaptable to mining operations were the mineral seam to be mined is relatively thick. Consequently, a mining machine drum drive arrangement with a planetary gear train in the intermediate drum section is not desirable for thin seam mining operations.

U.S. Pat. Nos. 3,774,969 and 3,848,930 are further examples of drum drive arrangements in which the intermediate drum section transmits rotation to the canted end drum sections. The canted end drum sections extend outwardly at an angle with respect to the intermediate drum section so that end drum drive shafts are not axially aligned with the intermediate drum drive shafts. The input drive shafts extend from the drive motors in parallel relation to the longitudinal axis of the mining machine. Because the end drum sections are canted outwardly, the end drum drive shafts are positioned at an angle greater than 90° with respect to the input drive shafts.

U.S. Pat. No. 4,270,803 discloses a single planetary gear train positioned in each canted end drum section rather than in the intermediate drum section. With this arrangement, rotation is transmitted from the end drum sections to the intermediate section rather than from the intermediate section to the end drum sections. This arrangement permits a reduction in the diameter of the intermediate drum section to provide a more efficient dislodging operation for thin seam mining. Another advantage of this arrangement is the increased clearance provided around the intermediate drum section for the flow of dislodged material onto the gathering platform. Also, a smaller base diameter for the intermediate drum section is known to substantially prevent clogging of dislodged material between the mine face and the intermediate drum section.

One of the results of positioning a planetary gear train in the end drum sections in order to reduce the base diameter of the intermediate drum section is higher rotational speeds of the intermediate drum section and the end drum sections. This has the advantage of dislodging material from the mine face at a greater rate for increased productivity of the mining machine. However, dislodging material at an increased rate generates more dust, which is circulated in the mine atmosphere and particularly at the mine face in coal mining operations. The suppression of the generation of respirable dust in the mine atmosphere as a result of the mining operation has become the subject of increased federal regulation in the area of mine health and safety.

Another consequential result of rotating the cutter drum at an increased rotational speed by the provision of a planetary gear train in the end drum section is increased wear of the drive components, particularly the drive components which transfer the drive from the end drum sections to the intermediate drum section. Wear of drive components is a problem, particularly at the point of coupling the drive from the planetary gear train to the end drum section and to the end drum drive shaft that rotates the end drum section. When the rotating cutter drum is subjected to overload conditions, wear of these components is accelerated. Consequently, replacement of these worn drive components is costly in the terms of lost productivity due to downtime.

While it has been suggested to provide a mining machine cutter drum drive for transmitting rotation by a planetary gear train from canted end drum sections to the intermediate end drum section, the known devices generate undesirable concentrations of respirable dust in their mining operation. Also, accelerated wear of the drive components of the canted end drum sections is encountered as a result of operating this type of cutter drum assembly at a higher rotational speed. Therefore, there is a need for a cutter drum having canted end sections that utilizes a planetary gear train operable to transmit rotation form the end drum sections to the intermediate drum section at a rotational speed for a desired rate of dislodging material from the mine face while reducing the concentration of respirable dust normally generated in the mine atmosphere and for reducing the wear on the drive components to extend the operating life of the drum drive assembly.

SUMMARY OF THE INVENTION

In accordance with the present invention, there is provided a continuous mining machine that includes a body portion. Propelling means supports the body portion for advancing the body portion. A boom member is pivotally secured to the body portion and extends forwardly therefrom. A drum member is rotatably mounted on the front of the boom member transversely to the body portion. The drum member has cutting elements extending therefrom to provide a continuous cutting pattern along the length of the drum member. The drum member has an intermediate drum section and a pair of end drum sections. The pair of end drum sections extends outwardly from the ends of the intermediate drum section, respectively. The end drum sections are spaced from the intermediate drum section to form a pair of openings between the intermediate drum section and the respective end drum sections. Power means is mounted on the body portion for rotating the drum member. Drive means transmits rotation from the power means to the drum member. The drive means includes input drive shaft means for transmitting rotation to the end drum sections. The input means extends from the power means through the pair of openings. The output drive means is drivingly connected to the input drive means to transmit rotation from the end drum sections to the intermediate drum section. The input drive means includes a first input shaft and a second input shaft. The first and second input shafts each include a first end portion and a second end portion. The first input shaft first end portion is drivingly connected to the power means. The second input shaft first end portion is drivingly connected to a respective one of the end drum sections. The first and second input shaft second end portions are drivingly connected to each other. The intermediate drive means includes a two stage planetary gear assembly. The two stage planetary gear assembly includes a first stage and a second stage. The first stage is drivingly connected to the second stage. An end drum drive shaft is nonrotatably connected to the respective end drum sections. The planetary gear assembly first and second stages are mounted in an end to end relation in each end drum section around the intermediate drum drive shaft. The first stage is drivingly connected to the second input shaft first end portion. The second stage is drivingly connected to the end drum drive shaft, thereby transmitting rotation from the input drive shaft means through the planetary gear assembly first and second stages to the end drum section.

Further in accordance with the present invention, there is provided a coupling axially mounted in the respective end drum sections in surrounding relation with the intermediate drum drive shaft. The coupling is axially aligned with the two stage planetary gear assembly and is positioned adjacent to the second stage of the planetary gear assembly on the intermediate drum drive shaft.

The coupling includes inner and outer annular surfaces which are drivingly connected to the end drum drive shaft and to the intermediate, respectively. A web section extends between the inner and outer surfaces of the coupling to provide the coupling with an I-shaped configuration in section. This structure permits the coupling to operate as a shear coupling. In the event a predetermined overload is applied to the drum drive, the shear coupling will fail before any of the other drive components fail. The shear coupling is positioned at the end of the intermediate drum drive shaft so as to facilitate ease of assembly and disassembly of the end drum section to replace a sheared coupling. As a result, the coupling is easily replaced in the event of failure, thus substantially reducing the downtime for repair of the drum drive as well as the expense of the replacement of some of the internal drive components which would otherwise be subject to failure in the absence of the shear coupling.

Accordingly, the principal object of the present invention is to provide a continuous mining machine having a cutter drum assembly that includes a pair of end drum sections extending outwardly from an intermediate drum section where rotation is transmitted from the end drum sections to the intermediate drum section by a drive arrangement for rotating the cutter drum at a speed for efficiently dislodging mine material from a mine face while reducing the volume of respirable dust that is generated during the dislodging operation.

Another object of the present invention is to provide a cutter drum drive assembly for a continuous mining machine in which drum drive is transmitted outwardly to a pair of end drum sections and therefrom inwardly to an intermediate drum section in an arrangement that promotes extended life of the drive components.

A further object of the present invention is to provide a continuous mining machine drum drive assembly for transmitting rotation from a pair of end drum sections to an intermediate drum section in which a shearable coupling in the end drums provides the drive assembly with protection against drive component failure under overload conditions.

These and other objects of the present invention will be more completely disclosed and described in the following specification, the accompanying drawings, and the appended claims.

DESCRIPTION OF THE PREFERRED EMBODIMENTS

Figure 1:
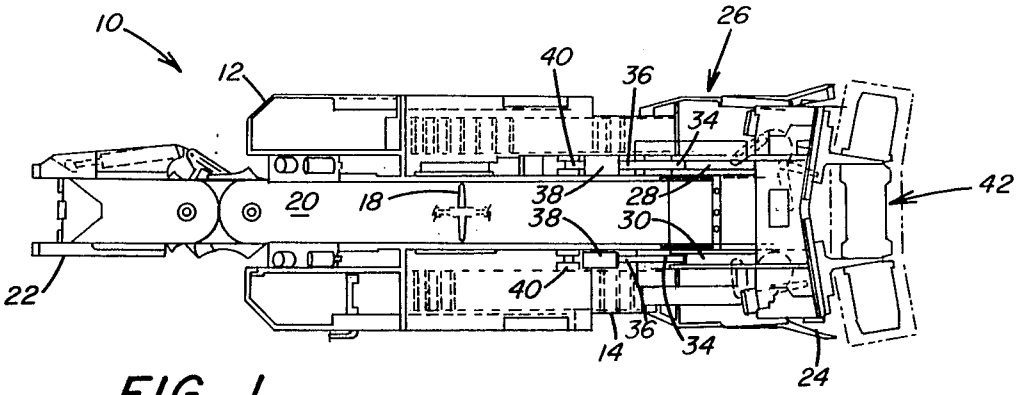
FIG. 1 is a top plan view of a continuous mining machine, illustrating a cutter drum member with end portions which are driven by the drum drive assembly of the present invention.
Figure 2:
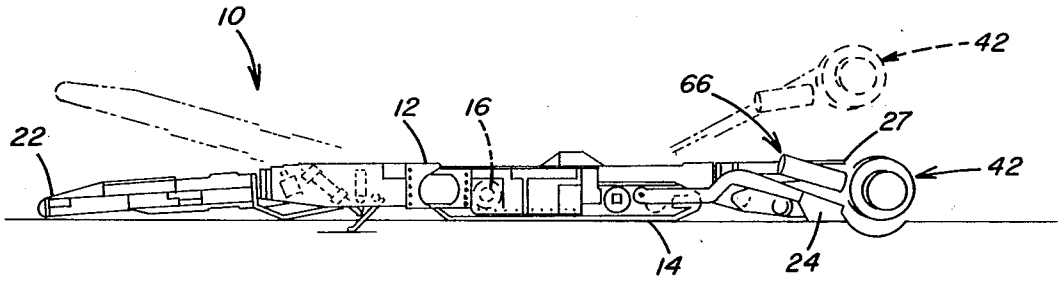
FIG. 2 is a view in side elevation of the continuous mining machine shown in FIG. 1, illustrating the vertical pivotal movement of the cutter drum member.

Referring to the drawings and, particularly to FIGS. 1 and 2, there is illustrated a continuous mining machine generally designated by the numeral 10 that has a body or frame portion 12 suitably mounted on endless crawler tracks 14. Motors 16 are provided to propel the mining machine 10 on the endless crawler tracks 14 to advance the mining machine during the mining operation. An endless conveyor mechanism 18 is positioned in a longitudinal trough 20 and conveys dislodged material therein from the front of the mining machine to an articulated rear discharge section 22. As illustrated in FIG. 2, a gathering device 24 extends forwardly from the body portion 12 and is arranged to gather and feed the dislodged material onto the conveyor trough 20 so that the dislodged material can be conveyed rearwardly by the endless conveyor mechanism 18 to the discharge section 22.

Figure 3:
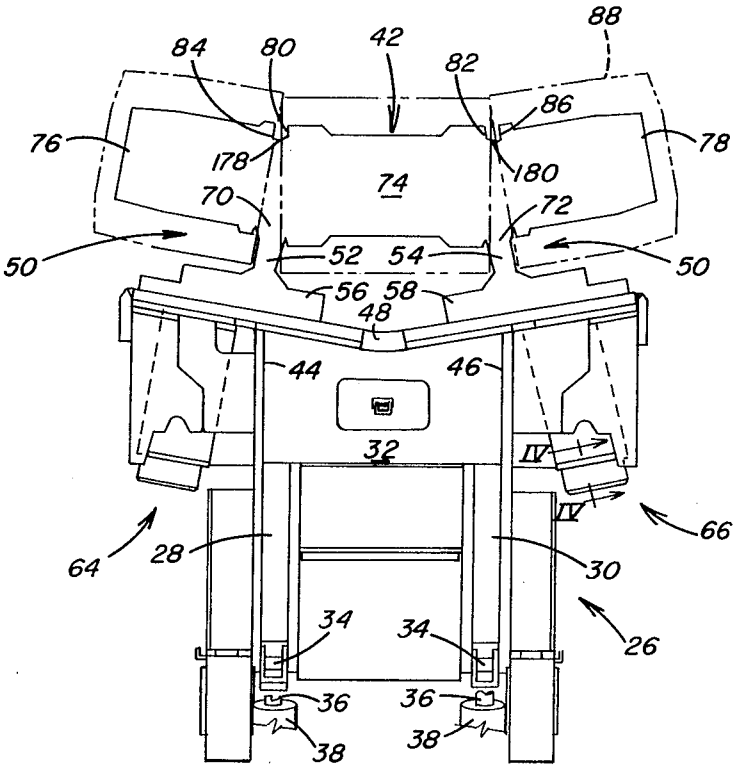
FIG. 3 is an enlarged, fragmentary top plan view of the cutter drum member rotatably mounted on the front of the boom member.

As illustrated in FIGS. 1 and 2 and in greater detail in FIG. 3, a boom member generally designated by the numeral 26 extends forwardly from the body portion 12. A cover plate 27, shown in FIG. 2, extends from the receiving end of the conveyor mechanism 18 forwardly into overlying relation with the front edge of the gathering device 24. As shown in FIG. 1, the boom member 26 includes a pair of parallel, rearwardly extending arm members 28 and 30 that are connected at the forward end portions to a housing 32, shown in FIG. 3, that extends transversely across the front of the mining machine 10.

Each of the arm members 28 and 30 are pivotally connected in a well known manner to the mining machine body portion 12. The arm members 28 and 30 are also connected at a pivot point 34 to a piston rod 36 of a piston cylinder assembly 38. The pair of piston cylinder assemblies 38 are pivotally connected to the mining machine body portion 12 at pivot points 40 shown in FIG. 1. With this arrangement, the boom arm members 28 and 30 are connected to pivot vertically on the mining machine body portion 12. Upon extension and retraction of the piston rods 36 within the piston cylinder assemblies 38, the boom member 26 pivots about the pivot points 34 of the arm members 28 and 30. In this manner for example, the boom member 26 moves vertically to a position illustrated in phantom in FIG. 2.

A cutter drum assembly generally designated by the numeral 42 connected to the boom member 26 performs an upward shear cut of the mine face. Also, the mining machine 12 is operable to advance into the mine face with the boom member 26 in the upper position. The piston cylinder assemblies 38 are operable to pivot the boom member 26 downwardly to the position illustrated by the solid lines in FIG. 2. In this manner, the cutter drum assembly 42 dislodges material from the mine face by a downward shear cut.

The boom member 26 has a second pair of arm members 44 and 46 that extend forwardly from the boom housing 32, as illustrated in FIG. 3. The forward end portions of the arm members 44 and 46 are connected to one another by a transverse support member 48. The cutter drum assembly 42 is supported by a drum housing generally designated by the numeral 50. The drum housing 50 includes a pair of rearwardly extending arm members 52 and 54 which are connected to the transverse support member 48.

The drum housing 50 also includes a pair of laterally extending arm members 56 and 58 that are positioned forwardly of and in abutting relation with the boom member transverse support member 48. The drum housing laterally extending arm members 56 and 58 are connected by a plurality of fastening devices (not shown) to the transverse support member 48. With this arrangement the cutter drum assembly 42 is connected to the boom member 26.

Figure 4:
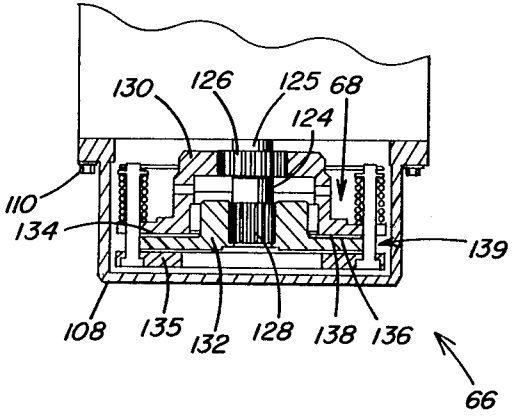
FIG. 4 is a fragmentary view, partially in section, of one of the drive motors, taken along line IV—IV of FIG. 3 illustrating a clutch mechanism for the drive motor which drives the cutter drum member.

A pair of boom mounted cutter drum motors 64 and 66, shown in FIG. 3, are mounted on the boom member 26 and are operable to rotate the cutter drum assembly 42. The rearward portion of the motor 66 is shown in FIG. 4 with the details of a clutch mechanism 68 which is common to both motor 64 and 66. The cutter drum motor 66 is also illustrated in FIG. 2. The motors 64 and 66 are suitably bolted to the drum housing 50 which is connected to the boom member 26, as above discussed. In an alternative arrangement (not shown) cutter drum motors can be mounted on the mining machine body portion 12 and drivingly connected by forwardly extending drive shafts to drum clutch mechanisms integrally connected to the gear case which extends forwardly from the boom arm member 44 and 46.

Figure 5:
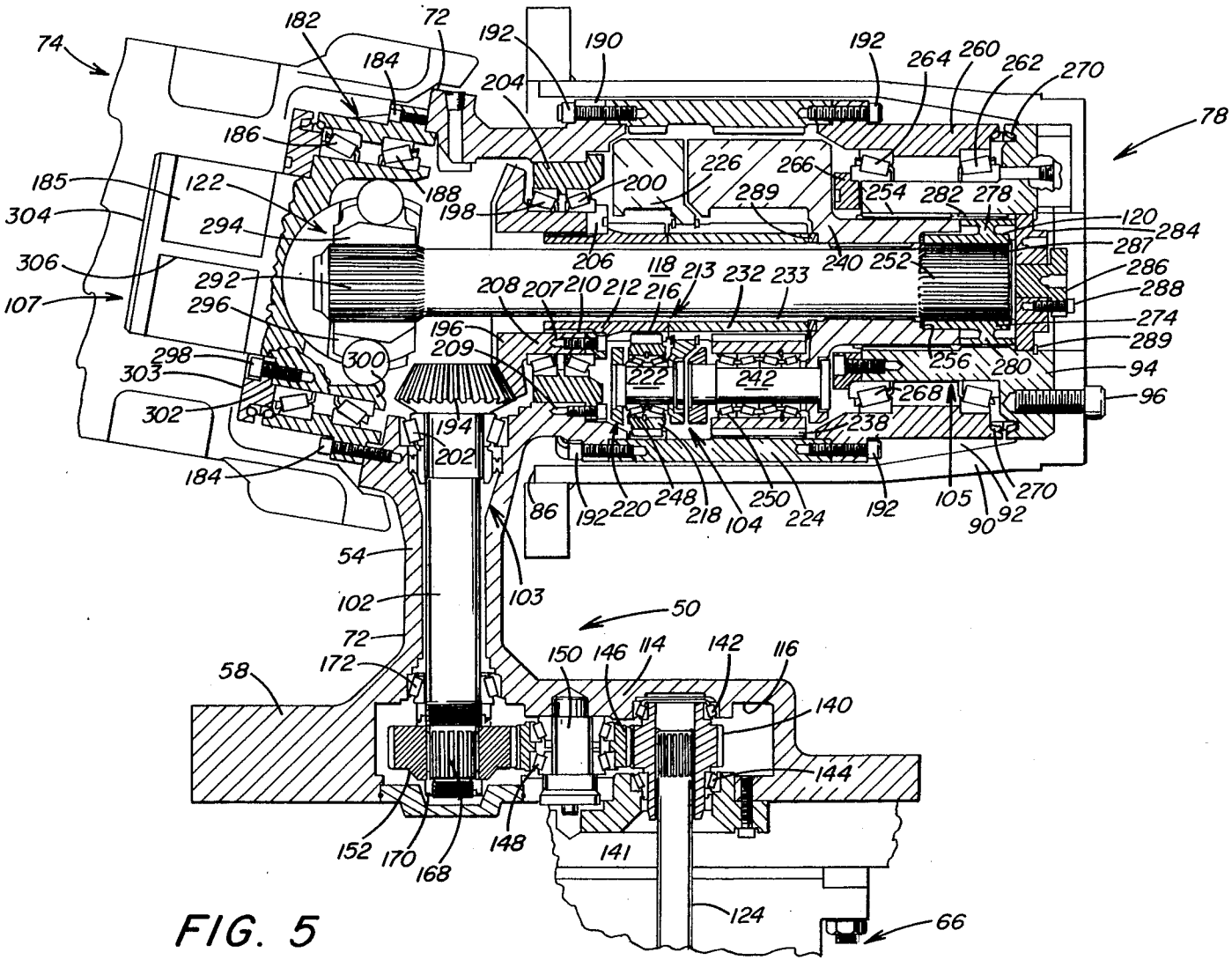
FIG. 5 is an enlarged, sectional view of the drive connection to one of the end drum sections for transmitting rotation from the end drum section to the intermediate drum section.

As illustrated in FIGS. 3 and 5, the drum housing 50 includes nonrotatable annular housing portions 70 and 72 which extend forwardly from the drum housing arm members 52 and 54. The rotatable portions of the cutter drum assembly 42 are mounted on the nonrotatable annular housing portions 70 and 72. The drive means for the cutter drum assembly 42 extend through the annular housing portions 70 and 72 and are connected to gearing of the cutter drum assembly 42 to rotate the cutter drum assembly 42 to dislodge material from the mine face.

The cutter drum assembly 42 has an intermediate drum section 74 and a pair of end drum sections 76 and 78. The intermediate drum section 74 is rotatably supported by the annular housing portions 70 and 72. The end drum section 76, as illustrated in FIG. 3, is canted with respect to the intermediate drum section 74 and is rotatably supported by the annular housing portion 70. Similarly on the opposite end of the cutter drum assembly 42, the end drum section 78 is canted with respect to the intermediate drum section 74 and is rotatably supported by the annular housing portion 72. The end drum section 78 is illustrated in detail in FIG. 5. It should be noted that the end drum section 78 as shown in FIG. 5 is not oriented in a position corresponding to the canted position shown in FIG. 3. Therefore, it should be understood that the correct relative angular position of the canted end drum section 78 is shown in FIG. 3. The end drum section 78 is shown in a position in FIG. 5 to facilitate illustration of an enlarged sectional view.

The intermediate drum section 74 has outer annular edge portions 80 and 82, and the end drum sections 76 and 78 have inner annular edge portions 84 and 86. The intermediate drum section 74 and the end drum sections 76 and 78 include a plurality of cutting elements that extend peripherally from the respective drum sections. The end drum sections 76 and 78 are positioned so that the bit pattern formed by the row of cutting elements along the inner annular edge portions 84 and 86 overlap the bit pattern of the row of cutter elements along the intermediate drum section outer annular edge portions 80 and 82 along the front of the cutter drum assembly 42. The bit pattern of the respective drum sections divert rearwardly along the rear of the cutting drum assembly 42 so that at this point the cutting elements of the intermediate drum section 74 are spaced from the cutting elements of the end drum sections 76 and 78.

As illustrated in FIGS. 1 and 3, the individual cutting elements have been eliminated for the purposes of clarity of illustration of the cutter drum assembly 42, but the cutter bit pattern is indicated by the -. line 88. Thus, with the above arrangement, the cutter drum assembly 42 is operable to dislodge a continuous kerf from the mine face without leaving unmined portions in the face. As the cutter drum assembly 42 completes a shear cut in the mine face, a relatively horizontal floor and roof are formed in the mine passageway.

Each of the end drum sections 76 and 78 has an identical configuration; therefore, the structure of the end drum section 78 will only be described. As illustrated in FIG. 5, the drum member end section 78 has a cup-shaped body portion 90 having the inner annular edge portion 86 and an opening 92. A drive shaft 94 is connected to the body portion 90 by suitable fastening devices 96 to transmit rotation to the body portion 90 which carries the cutting elements for the end drum section. Rotation from the pair of drum rotating motors 64 and 66 is transmitted to the drive gearing of the cutter drum assembly 42. Each motor 64 and 66 is drivingly connected through a drum clutch mechanism 68 shown in FIG. 4 to an input drive shaft 102 of a bevel pinion gear set generally designated by the numeral 103 in FIG. 5.

As shown in FIG. 5 the bevel pinion gear set 103 transmits rotation to a two stage planetary gear assembly 104 in each end drum section 76 and 78. The two stage planetary gear assembly 104 transmits rotation to an end drum shaft assembly generally designated by the numeral 105. The rotation of the end drum shaft assembly rotates the respective end drum sections 76 and 78. Rotation of the end drum shaft assembly 105 is transmitted to a driven shaft generally designated by the numeral 107 in FIG. 5 for rotating the intermediate drum section 74. It should be understood that the drive gearing for the other drum section 76, illustrated in FIG. 3, is identical to that illustrated in FIG. 5 for the end drum section 78. Thus, the following description will be confined to the drive means for the end drum section 78 and the intermediate drum section 74.

As illustrated in FIG. 4, each drive motor 64 and 66 includes the drum clutch mechanism 68 which is enclosed in a motor housing 108 that is connected by bolts 110 to the body of the motor 66, illustrated in FIG. 5. The motors 64 and 66 are bolted to the housing 50 which includes the arm members 54 and 58 which are adapted for bolting to the transverse support member 48 of the boom member 26 illustrated in FIG. 3

The housing 50 as shown in FIG. 5 includes a gear case portion 114 having a cup-shaped recess 116 for receiving the drive connection from the motor 66. The gear case portion 114 is formed integral with annular housing portion 72 on which the intermediate drum section 74 and the end drum section 78 are rotatably mounted. The input drive shaft 102 of the bevel gear set 103 extends through the housing portion 72 and is connected to the two stage planetary gear assembly 104 within the end drum section 78 for rotating the end drum shaft assembly 105 to rotate the end drum 78 to dislodge material from the mine face. The end drum drive shaft assembly 105 includes an intermediate drum drive shaft 118 which is drivingly connected at one end to the end drum shaft 94 by a shear coupling 120. The intermediate drum drive shaft 118 is connected at the opposite end through a universal joint assembly generally designated by the numeral 122 to the driven shaft 107 of the intermediate drum section 74. Thus, shaft 118 transmits drive from the end drum shaft 94 to the shaft 107 to rotate the intermediate drum section 74.

Referring to FIG. 4 the motor 66 includes a motor shaft 125 having an end portion 126 connected to the clutch mechanism 68 at the back end of the motor 66. A shaft 124 is externally splined at end portion 128 shown in FIG. 4 and at end portion 141 shown in FIG. 5. The shaft end portion 126 is drivingly connected to a first drive disk 130, and the shaft portion 128 is connected to a second drive disk 132. The drive disk 130 includes a face 134, and the drive disk 132 includes a face 136. A suitable friction material 138 is bonded to drive disk face 136. Similarly a pressure plate 135 abuts against friction material bonded to the opposite face of drive disk 132. A circle of spring bolts 139 urge pressure plate 135 against drive disk 132 to maintain the friction material 138 compressed between the driving faces 134 and 136. As shown in FIG. 5 a gear 140 is rotatably supported by bearing assemblies 142 and 144 in the gear case portion 114 on the opposite end of the motor shaft 124. The splined end portion 141 of shaft 124, as seen in FIG. 5, meshes with the gear 140.

The gear 140 transmits rotation from the shaft 124 to a meshing gear 146 that is rotatably supported by a bearing assembly 148 on a shaft 150 mounted within the gear case portion 114. The gear 146 meshes with a gear 152, which is nonrotatably connected to a splined end portion 168 of the input drive shaft 102. A nut 170 retains the gear 152 on the shaft splined end portion 168. The input drive shaft 102 is rotatably supported within the gear case portion 114 by a bearing 172.

As illustrated in FIG. 3, the annular edge portions 80 and 82 of the intermediate drum section 74 and the edge portions 84 and 86 of the end drum sections 76 and 78 are spaced apart to form a pair of openings 178 and 180 between the intermediate drum section 74 and the respective end drum sections 76 and 78. The drum housing 50 is positioned between the openings 178 and 180. The annular housing portions 70 and 72 extend around the openings 178 and 180 respectively and rotatably support the intermediate drum section 74 and the end drum sections 76 and 78.

The drum housing 50, as shown in FIG. 5, includes a bearing assembly generally designated by the numeral 182 that is connected by bolts 184 to the annular housing portion 72. The driven shaft 107 includes a shaft portion 185 which is rotatably supported within the bearing assembly 182 by bearings 186 and 188. The intermediate drum section 74 is nonrotatably connected to the end of the shaft portion 15. The end drum section 78 includes a bearing housing 190 which is connected by bolts 192 to the annular housing portion 72. With this arrangement, the intermediate drum sections 74 and the end drum section 76 and 78 are rotatably supported on the end of the boom member 26.

The input drive shaft 102 and the shaft 124 are positioned at an angle and preferably at an acute angle with respect to the longitudinal axis of the mining machine body portion 12. This is illustrated in FIG. 3 by the angular relationship of the housing portions 70 and 72 to the longitudinal axis of the mining machine body portion 12. The shafts 102 and 124 are drivingly connected by the set of meshing gears 140, 146 and 152, as shown in FIG. 5.

With the above described arrangement, it is possible to provide a cutter drum with canted end drum sections 76 and 78 where sufficient spacing is provided in the respective end drum sections for mounting the two stage planetary gear assembly 104 thereby removing the drive gearing from the intermediate drum section 74. This permits a reduction in the diameter of the intermediate drum section 74 and provides increased clearance around the intermediate drum section 74 for movement of dislodged material from the mine face rearwardly onto the mining machine gathering platform. Further by angling the input drive shaft 102 and the shaft 124 with respect to the mining machine longitudinal axis, the shafts 102 and 124 are capable of being positioned perpendicularly relative to the intermediate drum drive shaft 118 for the canted end drum sections 78, as shown in FIG. 5.

The bevel pinion gear set 103 shown in FIG. 5 includes a pinion 194 secured to the outer end portion of the input drive shaft 102. The pinion 194 meshes with a bevel gear 196. The bevel gear 196 is rotatably supported within the end drum section 78 by bearings 198 and 200. The pinion 194 is rotatably supported within the annular housing portion 72 by the bearing 202. The bearings 198 and 200 are positioned in surrounding relation with the shaft portion of the bevel gear 196 by a bearing carrier 204. A retainer plate 206 on the end of a shaft portion 208 of the bevel gear 196 maintains the bearing 200 in its desired position. The retainer plate 206 is connected by bolt 207 to the shaft portion 208. The bearing carrier 204 is connected by bolt 209 to the arm member 54.

The shaft portion 208 is connected to the external splines 210 of a sun gear 212 of a first or primary stage 213 of the two stage planetary gear assembly 104. Thus, rotation of the input shaft 102 is transmitted by the pinion gear 194 to the bevel gear 196 and therefrom to the sun gear 212. The sun gear 212 includes an axial bore through which the drive shaft 118 extends. The sun gear 212 is rotatable about the drive shaft 118. The sun gear 212 includes an outer tubular gear portion 216 that meshes with a plurality of planet gears 218, one of which is shown in FIG. 5.

A planetary carrier assembly generally designated by the numeral 220 includes a planetary carrier 226 and a planet gear support shaft 222 for rotatably supporting the planet gears 218 in meshing relation with the outer tubular gear portion 216 of the sun gear 212. It should be understood that a planetary shaft 222 is provided for each of the planet gears 218. The planet gears 218 mesh with the sun gear 212 and a ring gear 224. The ring gear 224 is secured to the bearing housing 190 by the bolts 192. Rotation of the sun gear 212 revolves the planetary gears 218 on the fixed ring gear 224. The planetary carrier assembly 220 rotates about the axis of the sun gear 212 which is concentric with the longitudinal axis of the end drum section 78.

The planetary carrier 226 is drivingly connected to a sun gear 232 of a second or final stage 233 of the two stage planetary gear assembly 104. Rotation of the carrier 226 is transmitted to the sun gear 232. The bores of the sun gears 212 and 232 are aligned to receive the drive shaft 118. The sun gear 232 is rotatable relative to the shaft 118. The sun gear 232 meshes with a plurality of planet gears 238, one of which is also shown in FIG. 5.

The second stage 233 of the planetary gear assembly 104 also includes a planetary carrier 240 having a planetary gear support shaft 242 for rotatably suporting the planet gear 238 in meshing relation with the outer tubular gear portion of sun gear 232. A shaft 242 is provided for each of the planet gears 238. The planet gears 238 also mesh with the ring gear 224. Thus rotation of the sun gear 232 revolves the planetary gears 238 on the fixed ring gear 224. The axis of rotation of the planetary carriers 226 and 240 about the respective sun gears 212 and 232, respectively, is concentric with the longitudinal axis of the end drum section 78. It should also be noted that the planet gear support shafts 222 and 242 of both the first stage 213 and the second stage 233 of the planetary gear assembly 104 are rotatably supported by bearing assemblies 248 and 250, respectively.

The planetary carrier 240 includes an externally splined portion 254 which is splined to the end drum drive shaft 94. The outer end of the planetary carrier 240 abuts against a thrust ring 256 which, in turn, abuts against the coupling 120 on the end of drive shaft 118. The end drum shaft 94 is rotatably supported within a tubular housing 260 by bearings 262 and 264 around the drive shaft 118. The housing 260 is also connected by bolts 192 to the fixed ring gear 224. A bearing retainer 266 is secured to end drum shaft 94 by bolts 268 and supports the bearing 264.

The bearings 262 and 264 are sealed by seal rings 270 which are positioned, as shown in FIG. 5, between the adjacent ends of the end drum shaft 94 and the tubular housing 260. The end drum section 78 includes the outer cylindrical cup-shaped housing 90. Housing 90 includes a cylindrical sidewall which surrounds the bearing housing 190, the ring gear 224, the housing 260, and the end drum shaft 94. The cutting elements (not shown) are secured to the sidewall of the cylindrical housing 90. The cylindrical housing 90 also includes an end wall which is connected to the end drum drive shaft 94 by the bolts 96.

Further in accordance with the present invention the end drum shaft assembly 105 includes the shear coupling 120 which is axially mounted, as shown in FIG. 5, on the intermediate drum drive shaft 118 and is drivingly connected to the end drum shaft 94. The shear coupling 120 has a splined inner annular portion 274 integrally connected by a web portion 278 to a splined outer annular portion 280. The splined inner angular portion 274 engages the externally splined portion 252 of the intermediate drum drive shaft 118. The splined outer annular portion engages the internal splines 282 of the end drum shaft 94.

The shear coupling 120 is removably positioned in the end drum section 78 for ease of assembly and disassembly by the provision of a retainer plate 284 and a plug 286. The plug 286 is shimmed against the plate 284 by bolts 288. The plug 286 extends through a bore in the retainer plate 284. The retainer plate 284 is secured in place within the end drum shaft 94 by a snap ring 289. Another snap ring 287 is positioned on the outer end of the shaft 118 between the coupling and the plug 286. The snap ring 287 when in place is fixed on the end of shaft 118 and abuts against the coupling 120 to prevent movement of the shaft 118 out of the coupling 120. Removal of the snap ring 287 permits axial movement of the coupling 120 on the shaft 118 to facilitate replacement of a broken coupling 120. The opposite end of the coupling 120 abuts against the thrust ring 256. The opposite face of the thrust ring 256 abuts carrier assembly 240. The carrier assembly 240 abuts against a thrust washer 289 which, in turn, abuts against the end of the sun gear 232. The sun gear 232 abuts against the sun gear 212 which is held in place around shaft 118 by abutting contact with the retainer plate 206 secured to the bevel gear shaft portion 208. With this arrangement, the coupling 120 is precisely located on the intermediate drum drive shaft 118.

With the above discussed arrangement, rotation is transmitted from the bevel pinion gear set 103 to the primary planetary assembly 213 to the final planetary assembly 233 and therefore to the end drum shaft assembly 105. Transmission of rotation from the final planetary assembly 233 to the end drum shaft assembly 105 is accomplished by the connection of the sun gear 232 to the carrier assembly 240 and the meshing engagement of assembly 240 with the end drum shaft 94. Rotation of the end drum shaft 94 is transmitted to the cup-shaped body portion 90 of the end drum section 78 and therefrom to the shaft 118 and the intermediate drum section 74. The transfer of rotation by the two stage planetary gear assembly 104 to the end drum shaft 94 permits the end drum sections 76 and 78, as well as the intermediate drum section 74, to be driven at a high torque but with a rotational speed sufficiently reduced to generate less dust during the mining operation without an accompanying reduction in the productivity of the mining operation.

The shear coupling 120 has an I-configuration formed by the web portion 278 connecting the inner and outer annular portions 274 and 280. This configuration is designed to shear or fail at a predetermined overload condition which is considered to exert an undesirable stress on the intermediate drum section 74. Thus the coupling 120 will shear and thereby protect the drive components of the intermediate drum section from failure.

The shear coupling 120 transmits rotation from the end drum shaft 94 to the drive shaft 118 in the end drum section 78. With this arrangement, the shear coupling 120 serves as the drive connection between the end drum shaft 94 and the drive shaft 118 for the transmission of low speed, high torque rotation from the two stage planetary gear assembly 104 to the intermediate drum section 74. In the event the intermediate drum section 74 is subjected to overload conditions in the dislodging of material from the mine face, the structure of the shear coupling 120 facilities shearing of the coupling 120 from its connecting relationship with the respective drum shafts 94 and 118.

Thus, in the event of overload conditions, shearing of the coupling 120 permits two stage planetary gear assembly 104 to rotate without transmitting drive to the intermediate drum drive shaft 118 and to the intermediate drum section 74. Consequently, when the mining machine 10 encounters overload conditions in the operation of dislodging solid material from the mine face, extensive internal failure of the drive components such as the bevel pinion set 103, the two stage planetary assembly 104, the end drum shaft assembly 105, and the intermediate drum drive shaft 107 is prevented. Replacement of a damage shear coupling 120 is efficiently accomplished by the above discussed arrangement for locating the coupling 120 on the shaft 118. Failure of the coupling 120 is designed to take place without damage to the external splines on the outer end portion of the intermediate drum drive shaft 118 and the internal splines of the end drum drive shaft 94.

Rotation of the end drum drive shaft 94 rotates the end drum section 78 which, in turn, generates rotation of the intermediate drum drive shaft 118. As shown in FIG. 5, the universal joint assembly 122 includes the drive shaft 118 having a second externally splined portion 292 nonrotatably connected to an arcuate geared portion 294 of universal joint member 296. The universal joint 296 is rotatably supported on a flanged race 300 of the driven shaft portion 185 of the intermediate drum section 74. The universal joint 296 with the arcuate geared portion 294 and the flanged race 300 of shaft portion 185 is known as a ball-type Rezeppa joint between the shafts 118 and 185.

The flanged race 300 includes a portion 302 which is connected by bolts 298 to a retainer plate 303 for the bearings 186 and 188. Thus, with this arrangement, rotation of the drive shaft 118 extending from the end drum section 78 is transmitted by the universal joint assembly 122 to the intermediate drum driven shaft 185 that rotates the intermediate drum section 74.

As further illustrated in FIG. 5, the intermediate drum driven shaft 185 includes an end portion 304 that includes a plurality of planar faces 306 which are connected to the body of the intermediate drum section 74. Bearings 186 and 188 rotatably support the shaft 185. With this arrangement, rotation is transmitted from the respective end drum sections 76 and 78 to the intermediate drum section 74 by rotation transmitted by the drive shaft 118 through the universal joint assembly 122 to the intermediate drum drive shaft 185.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A continuous mining machine comprising, a body portion, propelling means supporting said body portion for advancing said body portion, a born member pivotally secured to said body portion and extending forwardly therefrom, a drum member rotatably mounted on the front of said boom member transversely to said body portion, said drum member having cutting elements extending therefrom to provide a continuous cutting pattern along the length of said drum member, said drum member having an intermediate drum section and a pair of end drum sections, said pair of end drum sections extending outwardly from the ends of said intermediate drum section respectively, said pair of end drum sections being spaced from said intermediate drum section to form a pair of openings between said intermediate drum section and said respective end drum sections, power means mounted on said body portion for rotating said drum member, drive means for transmitting rotation from said power means to said drum member, said drive means including input drive shaft means for transmitting rotation to said end drum sections, said input drive shaft means extending from said power means through said pair of openings, output drive means positioned in said respective end drum sections and drivingly connected to said input drive means for transmitting rotation from said end drum sections to said intermediate drum section, said output drive means including an intermediate drum drive shaft in said respective end drum sections, an end drum shaft nonrotatably connected to said respective end drum section, a drive coupling axially mounted in each of said end drum sections in surrounding relation with said intermediate drum drive shaft, and said drive coupling including an external portion drivingly connected to said end drum drive shaft and an internal portion drivingly connected to said intermediate drum drive shaft to transmit rotation from said end drum drive shaft to said intermediate drum drive shaft.

2. A continuous mining machine as set forth in claim 1 in which, said pair of end drum sections are canted forwardly at an angle with respect to said intermediate drum section, said input drive shaft means including an input shaft positioned at an angle with respect to the longitudinal axis of said mining machine body portion, and means connecting said input shaft to said canted end drum section and said intermediate drum section.

3. A continuous mining machine as set forth in claim 1 in which, said input shaft drive means including a planetary gear assembly, said planetary gear assembly connected to said end drum section to transmit rotation to said end drum section, and said drive coupling being connected to said end drum section and said intermediate drum drive shaft such that rotation, of said end drum section is transmitted by said drive coupling to said intermediate drum drive shaft.

4. A continuous mining machine comprising, a body portion, propelling means supporting said body portion for advancing said body portion, a boom member pivotally secured to said body portion and extending forwardly therefrom, a drum member rotatably mounted on the front of said boom member transversely to said body portion, said drum member having cutting elements extending therefrom to provide a continuous cutting pattern along the length of said drum member, said drum member having an intermediate drum section and a pair of end drum sections, said pair of end drum sections extending outwardly from the ends of said intermediate drum section respectively, said pair of end drum sections being spaced from said intermediate drum section to form a pair of openings between said intermediate drum section and said respective end drum sections, power means mounted on said body portion for rotating said drum member, drive means for transmitting rotation from said power means to said drum member, said drive means including input drive shaft means for transmitting rotation to said end drum sections, said input drive shaft means extending from said power means through said pair of openings, output drive means positioned in said respective end drum sections and drivingly connected to said input drive means for transmitting rotation from said end drum sections to said intermediate drum section, said output drive means including an intermediate drum drive shaft in said respective end drum sections, an end drum drive shaft nonrotatably connected to said respective end drum section, a drive coupling axially mounted in each of said end drum sections in surrounding relation with said intermediate drum drive shaft, said drive coupling including a shearable body portion with an internally splined portion and an externally splined portion, said internally splined portion being drivingly connected to said intermediate drum drive shaft, and said externally splined portion being drivingly connected to said end drum drive shaft such that rotation is transmitted through said drive coupling from said end drum drive shaft and therefrom to said intermediate drum section.

5. A continuous mining machine comprising, a body portion, propelling means supporting said body portion for advancing said body portion, a boom member pivotally secured to said body portion and extending forwardly therefrom, a drum member rotatably mounted on the front of said boom member transversely to said body portion, said drum member having cutting elements extending therefrom to provide a continuous cutting pattern along the length of said drum member, said drum member having an intermediate drum section and a pair of end drum sections, said pair of end drum sections extending outwardly from the ends of said intermediate drum section respectively, said pair of end drum sections being spaced from said intermediate drum section to form a pair of openings between said intermediate drum section and said respective end drum sections, power means mounted on said body portion for rotating said drum member, drive means for transmitting rotation from said power means to said drum member, said drive means including input drive means for transmitting rotation to said end drum sections, said input drive means extending from said power means through said pair of openings, output drive means positioned in said respective end drum sections and drivingly connected to said input drive means for transmitting rotation from said end drum sections to said intermediate drum section, said output drive means including an intermediate drum drive shaft, said input drive means drivingly connected to a respective one of said end drum sections, said input drive means including a planetary gear assembly, said input drive means including an end drum drive shaft nonrotatably connected to said respective end drum section, said planetary gear assembly mounted around said intermediate drum drive shaft, a shearable drive coupling surrounding said intermediate drum drive shaft for transmitting rotation from said end drum drive shaft to said intermediate drum drive shaft, and said shearable drive coupling including an externally splined portion drivingly connected to said end drum drive shaft and an internally splined portion drivingly connected to said intermediate drum drive shaft.

6. A continuous mining machine as set forth in claim 5 in which, said shearable drive coupling has a I-configuration formed by a web portion connecting inner and outer annular portions, said inner annular portion including said internally splined portion and said outer annular portion including said externally splined portion, and said web portion designed to shear at a predetermined overload condition to interrupt the transmission of rotation from said end drum drive shaft to said intermediate drum drive shaft.

7. A continuous mining machine as set forth in claim 5 in which, said shearable drive coupling is positioned in axial alignment with said planetary gear assembly on said intermediate drum drive shaft.

8. A continuous mining machine as set forth in claim 5 in which, said end drum drive shaft has an outer end portion, said shearable drive coupling being positioned within said end drum drive shaft outer end portion, said end drum section having an axial opening positioned oppositely of said shearable drive coupling, retainer means positioned in said end drum section for closing said axial opening to sealingly retain said shearable drive coupling in said end drum section, and means for releasably connecting said retainer means to said end drum section to provide access to said shearable drive coupling through said axial opening.

9. A continuous mining machine as set forth in claim 5 in which, said shearable drive coupling is axially mounted within the outer end of said end drum drive shaft, and said planetary gear assembly being spaced inwardly from said shearable drive coupling to permit installation and replacement of said shearable drive coupling within said end drum drive shaft.

10. A continuous mining machine comprising, a body portion, propelling means supporting said body portion for advancing said body portion, a boom member pivotally secured to said body portion and extending forwardly therefrom, a drum member rotatably mounted on the front of said boom member transversely to said body portion, said drum member having cutting elements extending therefrom to provide a continuous cutting pattern along the length of said drum member, said drum member having an intermediate drum section and a pair of canted end drum sections, said pair of canted end drum sections extending angularly from the ends of said intermediate drum section respectively, said pair of canted end drum sections being spaced from said intermediate drum section to form a pair of openings between said intermediate drum section and said respective canted end drum sections, power means mounted on said body portion for rotating said drum member, drive means for transmitting rotation from said power means to said drum member, said drive means including input drive means for transmitting rotation to said canted end drum sections, said input drive means extending from said power means angularly relative to said body portion through said pair of openings, output drive means positioned in said respective canted end drum sections and drivingly connected to said input drive means for transmitting rotation from said canted end drum sections to said intermediate drum section, said output drive means including as intermediate drum drive shaft within said respective canted end drum sections, said input drive means including a two stage planetary gear assembly, said two stage planetary gear assembly including a first stage and a second stage, said first and second stages being drivingly connected to each other, an end drum drive shaft nonrotatably connected to said respective canted end drum section, said planetary gear assembly first and second stages mounted in end to end relation in said end drum section around said intermediate drum drive shaft, said first stage being drivingly connected to said input drive means, a shearable drive coupling surrounding said intermediate drum drive shaft for transmitting rotation from said end drum drive shaft to said intermediate drum drive shaft, said shearable drive coupling including an externally splined portion drivingly connected to said end drum drive shaft and an internally splined portion drivingly connected to said intermediate drum drive shaft, and said end drum drive shaft being drivingly connected to said intermediate drum section such that rotation is transmitted from said end drum drive shaft to said intermediate drum drive shaft.

11. A continuous mining machine as set forth in claim 10 in which, said planetary gear assembly first stage is positioned around said intermediate drum drive shaft adjacent to input drive means at one end of said intermediate drum drive shaft, said planetary gear assembly second stage being axially aligned in tandem relarion with said first stage, and said second stage positioned in surrounding relation with said intermediate drum drive shaft and drivingly conntected to said end drum drive shaft.

12. A continuous mining machine as set forth in claim 10 which includes, bearing means for rotatably supporting said planetary gear assembly first and second stages in axial relation around said intermediate drum drive shaft between said input drive means and said shearable drive coupling, and said shearable drive coupling being axially supported on said intermediate drum drive shaft to transmit rotation from said end drum drive shaft to said intermediate drum drive shaft.

* * * * *